United States Patent [19]

DesRochers et al.

[11] Patent Number: 4,486,989

[45] Date of Patent: Dec. 11, 1984

[54] ELEVATED STORAGE TANK

[76] Inventors: Donald J. DesRochers, 8 Riverside Crescent, Toronto, Ontario, Canada; James M. Conners, 87 Holsworthy Crescent, Thornhill, Ontario, Canada, L3T 4C5

[21] Appl. No.: 397,671

[22] Filed: Jul. 12, 1982

[51] Int. Cl.[3] ..... E04H 7/02; E04H 12/34

[52] U.S. Cl. ..... 52/194; 52/73; 52/125.2; 52/745

[58] Field of Search ..... 52/194, 197, 73, 125.2, 52/745

[56] References Cited

U.S. PATENT DOCUMENTS

| | | | |
|---|---|---|---|
| 704,805 | 7/1902 | Jamieson | 52/197 |
| 2,104,896 | 1/1938 | Clever | 52/197 |
| 2,153,492 | 4/1939 | Workman | 52/197 |
| 2,417,053 | 3/1947 | Boardman | 220/1 |
| 3,073,018 | 1/1963 | Gauthron | 52/73 X |
| 3,219,224 | 11/1965 | Anderson | 220/1 |
| 3,363,795 | 1/1968 | Stuart | 220/1 |
| 3,633,325 | 1/1972 | Bartoli | 52/73 |
| 4,327,531 | 5/1982 | Cazaly et al. | 52/194 |
| 4,403,460 | 9/1983 | Hills | 52/745 |

FOREIGN PATENT DOCUMENTS

| | | | |
|---|---|---|---|
| 870858 | 5/1971 | Canada | 52/194 |
| 1091883 | 12/1980 | Canada . | |
| 1091884 | 12/1980 | Canada . | |
| 690156 | 10/1979 | U.S.S.R. | 52/73 |

*Primary Examiner*—Alfred C. Perham
*Attorney, Agent, or Firm*—Ridout & Maybee

[57] ABSTRACT

An elevated liquid storage tank has a tubular concrete shaft on which is supported a metal tank body. The tank body has a unitary bottom wall having an endless horizontal plate bearing on the top of the concrete shaft, and inner and outer conical portions extending upwardly from the horizontal plate. A bed of cementitious grout or other shiffening means are disposed within the lower portion of the bottom wall to withstand compressive forces urging the outer margin of the inner conical portion and the inner margin of the outer conical portion toward one another. A construction method, comprising erecting the tank bottom wall on the shaft and raising the pre-fabricated tank side wall up the side of the shaft is also disclosed.

13 Claims, 4 Drawing Figures

ELEVATED STORAGE TANK

The present invention relates to elevated liquid storage tanks having a metallic tank body supported on a tubular concrete shaft.

The inventors are aware of prior proposals for such tanks but all such proposals have exposed the anchors employed to secure the tank bottom to the shaft to high bending moments which the concrete is able only poorly to resist, or have required that the tanks be fabricated from plates of complex geometrical shapes thus greatly adding to the cost of construction.

In the tank of the present invention the bottom wall is of a novel unitary construction and has an endless horizontal metal plate bearing on and secured to a horizontal upper surface of the shaft. Inner and outer conical wall portions are connected to the plate and incline upwardly therefrom. With this arrangement, the forces imposed on the tank in service result in a downwardly-directed compressive reaction of the horizontal plate against the upper surface of the shaft and no bending moment is applied on the securing means. Only relatively simple conical curvatures need be imparted to the metallic components required to fabricate the tank bottom wall.

It has further been found that with this arrangement, in the lower zone of the tank bottom overlying the upper surface of the shaft, compressive forces are exerted on the lower ends of the inner and outer conical wall portions, with the result that these portions would have a tendency to buckle inwards in service.

The present invention accordingly provides an elevated liquid storage tank comprising an upwardly extending tubular concrete shaft providing a horizontal upper surface, a generally tubular metal tank body supported on the shaft and having a unitary bottom wall comprising an endless horizontal plate bearing on said surface, means securing the plate to said surface, an inner conical wall portion integrally connected to and inclining upwardly from the plate toward the center of the tank, and an outer conical wall integrally connected to and inclining upwardly from the plate to an outer side of the tank, and a tank side wall extending upwardly from the outer end of the outer conical wall, the lower portion of the tank bottom wall being adapted to withstand compressive forces urging the outer margin of the inner conical wall portion and the inner margin of the outer conical wall portion in the direction toward one another.

While it is possible to employ thicker gauge metal plate for the lower margins of the inner and outer conical portions in order to resist buckling pressure, this is not preferred, and in the preferred form compression-resistant stiffening means are distributed uniformly around an endless zone overlying the said horizontal plate adjacent to and engaging with the inner surfaces of the outer margin of the inner conical wall portion and the inner margin of the outer conical wall portion.

In one especially preferred form, the stiffening means are provided by a bed of set cementitious material disposed in an even layer around said zone.

The present invention will now be more fully described with reference to the accompanying drawings in which.

Figures 1, 4:
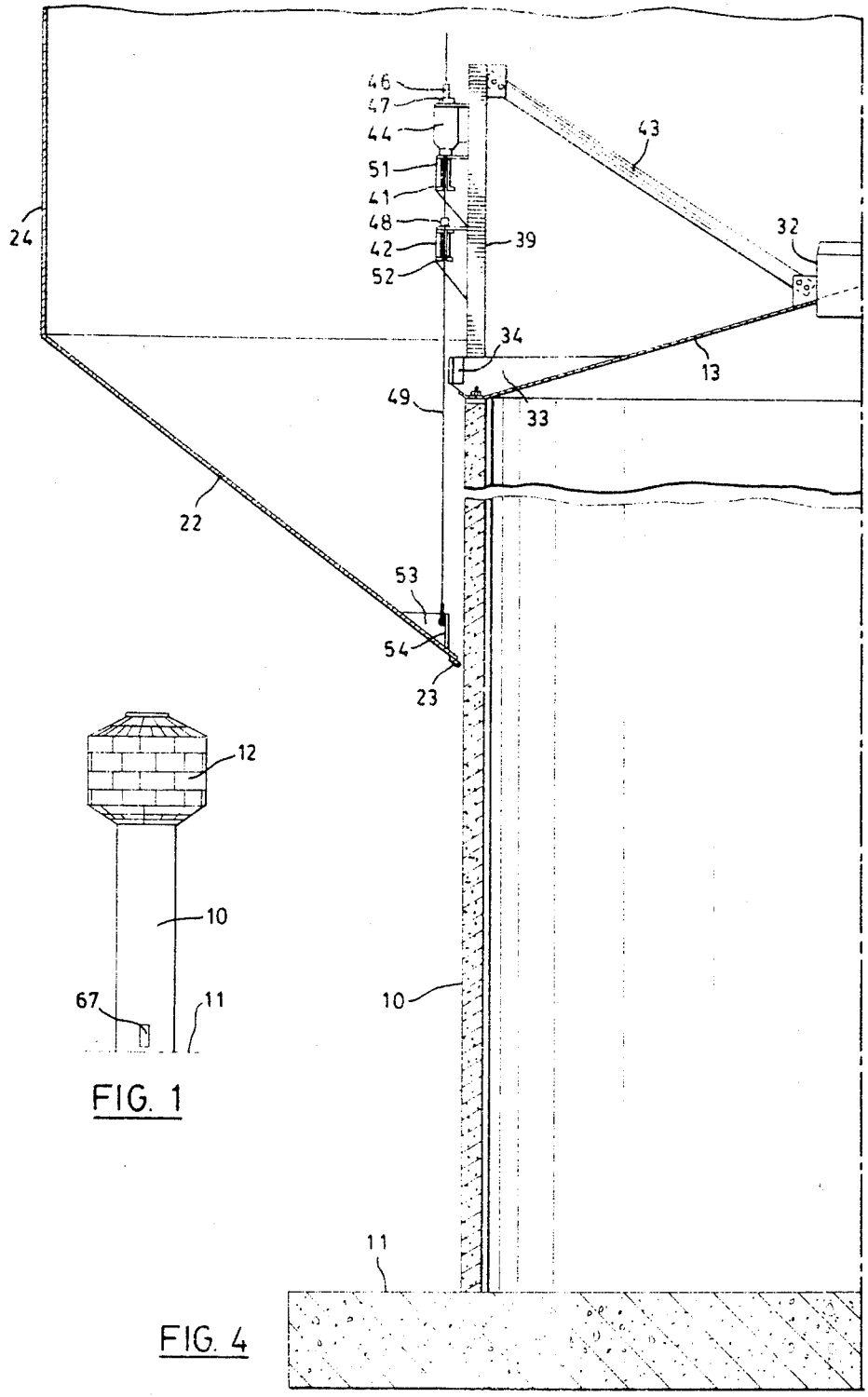
FIG. 1 shows a side view ot the elevated liquid storage tank.
FIG. 4 shows a vertical section through the tank in the course of construction.

FIG. 1 shows the completed tank having a cylindrical concrete shaft 10 supported on a support surface 11 and carrying at its upper end the metal tank body 12 which is formed as an assembly of welded metal plates. As shown in more detail in FIG. 4, the support surface 11 may comprise a concrete raft 11 providing a secure foundation for the structure.

Figure 2:
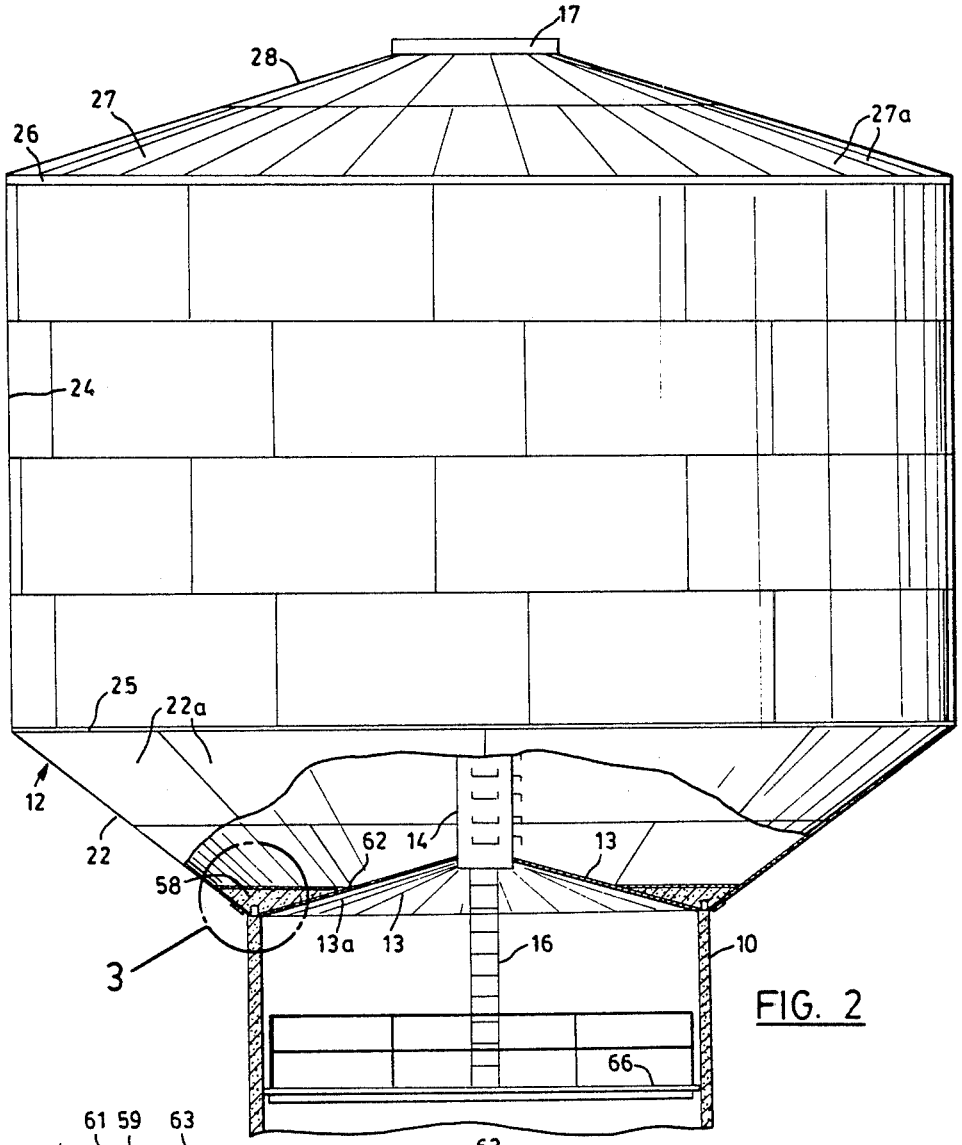
FIG. 2 shows a side view, partly in vertical section, of the upper end of the tank.
Figure 3:
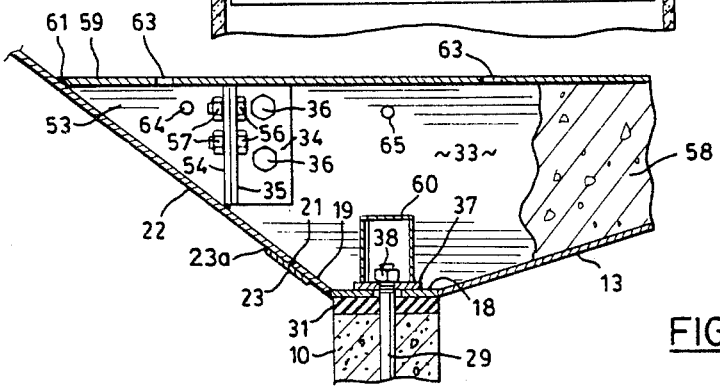
FIG. 3 shows an enlarged view of the area circled at 3 in FIG. 2.

As shown in more detail in FIGS. 2 and 3, the metallic tank body itself comprises an inner cone 13 formed of sector shaped plates 13*a* which are laterally curved so as to conform to a conical surface. At the center, these plates 13*a* define a circular opening the edges of which are welded to a metal tube 14 having a ladder 16 passing upwardly through it. The tube 14 terminates in a manhole at a cover plate 17 at the top of the tank and provided with removable covers from which access may be had to the interior of the tank.

At their outer edges the plates comprising the inner cone 13 are welded to an annular horizontal plate 18 which bears on the upper horizontal surface of the shaft wall 10.

On its outer side, the horizontal plate 18 is welded to a stub portion 19 which is of frustro-conical form and extends continuously circumferentially around the tank. The stub portion 19 is welded at a weldment line 21 to a major outer conical wall portion 22 and to a backing plate 23 which also extends continuously around the circumference of the tank and is welded to the main wall portion at a weldment 23*a* . It will be appreciated that the continuous plate 18, the continuous stub portion 19 and the continuous backing plate 23 will normally be formed of a number of sections welded together end to end.

As shown in more detail in FIG. 2, the outer conical wall portion 22 consists of a number of part-conical sector-shaped plates 22*a* welded together at their edges. At its upper edge the outer conical wall portion 22 is welded to a ring beam 25 on which is welded the main cylindrical side wall of the tank 24. As shown, this consists of a number of part cylindrical plates welded together. At its upper edge the side wall 24 terminates in a ring beam 26 on which is welded the lower edge of the conical roof which is formed in two parts, the lower part 27 being of frustro-conical section and being composed of a number of sector-shaped part-conical plates 27*a* and an upper cap portion 28 likewise formed of welded together plates. The upper edge of the lower roof portion 27 and the inner perimeter of the backing plate 23 define circular areas which are of sufficient size to provide an adequate clearance from the exterior surface of the shaft 10 to permit the entire tank body to be drawn upwardly from its point of assembly around the base of the shaft to its final position during the construction of the tank, as described in more detail later.

In the construction of the tank, the concrete shaft 10 is cast on the support raft 11 using conventional concrete casting techniques e.g. jump form casting. Steel anchor rods 29 having threaded upper ends are cast into the flat horizontal upper surface of the wall of the shaft 10, as shown in more detail in FIG. 3. A plurality of these anchors 29 are distributed around the perimeter of the wall of the shaft 10 at spacings appropriate to provide an adequate securement of the tank body to the shaft. An annular resilient pad e.g. of neoprene is then placed on the flat upper surface of the wall of the shaft 10, with the anchors 29 passing through the pad 31. The pad 31 serves as a load-distributing cushion between the tank and the concrete wall 10.

The inner conical section of the tank bottom is then assembled at ground level and is hoisted onto the top of the shaft 10 e.g. with a mobile crane. The floor section at this stage consists of the inner conical wall 13, the plate 18 and the stub section 19 of the outer conical wall. At this stage also, the inner conical wall 13 has welded at its center a short section of metal tube 32. At a later stage, as described in more detail hereinafter, a main section of tubing is welded to this short section 32, to complete the construction of the access tube 14. As assembled, the bottom wall section also includes a plurality of radially-directed vertically extending generally triangular plates 33. These plates 33 are closely and uniformly spaced around the circumference of the tank. Merely by way of example, it may be mentioned that in the case of a tank having a shaft 10 of approximately 21 feet diameter, about 32 of these vertical plates 33 will be uniformly spaced around the circumference of the bottom wall of the tank. Each plate 33 is welded to the bottom conical wall portion 13, to the upper surface of the plate 18, and to the upper surface of the stub portion 19. At the outer end of each plate 33 is carried a right-angled plate 34, one angle of which is bolted to the plate 33 by bolts 36. The other angle section 35 of the plate 34 is employed for temporarily fixing the inner conical section of the wall to the outer conical section during a subsequent stage of construction, as described in more detail later. The lower floor section is fitted in position on the shaft 10 with the anchors 29 being aligned with holes provided through the plate 18. These holes are made oversize so as to allow for any slight misalignment in the positioning of the anchors and the holes in the plate 18. Washers 37 and nuts 38 are then used to secure the plate 18 on the anchors 29. A plurality of jack stands are then temporarily secured on the top of the structure. These jack stands are used for hoisting the partially-completed tank body from ground level onto the top of the tank. As shown, these jack stands comprise a pair of vertical frame members 39, only one of which is visible in FIG. 4, with outrigger upper and lower cross members 41 and 42. Typically six of these jack stands will be arranged symmetrically around the periphery of the shaft 10. The lower end of each jack stand frame member 39 is temporarily secured to an adjacent plate 33 and prop members 43 connected between the upper ends of the jack stands and fixing points adjacent the tube section 32 may be employed to stabilize the stands. An hydraulic cylinder 44 is mounted on the upper cross member 41 of each jack stand, an upper strand anchor 46 is supported on the piston 47 of the cylinder 44, and a lower strand anchor 48 is supported on the lower cross member 42. A cable 49 is passed through each upper strand anchor 46, through a bore provided through the piston 47 and cylinder 44, through an upper guide connected on the upper cross piece 41, through the lower strand anchor 48, and through a lower guide 52 supported on the lower cross member 42. The strand anchors 46 and 48 are of the type conventionally employed in post- or pre-tensioning operations, and permit the cable to run through them in only one direction, in this case the upward direction. It will be appreciated, therefore, that by repeatedly extending and retracting the piston 47, the cable 49 is gripped by the upper strand anchor 46 as this is driven upwardly on the up-stroke of the piston 47, with the cable running upwardly through the lower strand anchor 48, and that on the downward stroke of the piston 47, the cable slips through the upper strand anchor 46 while being gripped against downward movement by the lower strand anchor 48, so that the cable 49 is raised in progressive increments.

Assembly of the major portion of the tank body 12 is conducted around the base of the shaft 10 at ground level. The tank body thus assembled consists of the major portion of the lower outer conical tank bottom 22, the ring beam 25, the cylindrical side wall 24, and the lower roof portion 27. Additionally, this assembly includes a continuous ring-form backing plate 23 which is welded on the lower margin of the major portion of the outer conical wall 22. Desirably, the jacking stands 39 are positioned at the top of the shaft 10 before assembly of the tank body commences so that these can be used for raising the components of the tank body during the course of construction which may then be conducted from the top downwards, i.e. the lower roof portion 27 is first fabricated, and is then raised by temporarily anchoring the cables 49 to the completed assembly. In the raised position this permits attachment of the ring beam 26, followed by the main cylindrical wall portion 24, this also being raised progressively during the course of construction, using the cables 49, the ring beam 25 then being attached to the lower side of the completed wall portion 24, and the major conical outer wall portion 22 then being attached to the ring beam 25.

A plurality of minor triangular plates 53 are also welded to the inner face of the lower margin of the wall portion 22. These minor plates 53 are arranged so that they correspond in angular position with the major plates 33. An endless cylindrical plate 54 is welded on the inner faces of the plates 53. Plate 54 is provided with pairs of holes through it which are slightly slotted, each pair corresponding in angular position with the pairs of holes provided through the outer angle section 35 of the angle plates 34 which are attached on the main triangular stiffener plates 33.

The cables 49 are then attached to the minor triangular plates 53, as shown in FIG. 4, and the jack stands 39 are employed to raise the body vertically up the wall of the outer shaft 10, as shown in FIG. 4 until the lower edge of the outer major conical wall portion 22 coincides with the upper edge of the stub portion 19, as shown in FIG. 3. Pairs of bolts 56 are passed through the holes in the angle plates 35 and the endless plate 54 and are secured in position by nuts 57, as shown in FIG. 3. The coinciding edges of the stub portion 19 and the wall portion 22 are then welded together and to the backing plate 23 along the weld line 21.

The jacking stands 39 can then be removed from the interior of the tank body, employing for example a mobile crane.

In service, the vertical stiffener plates 33 and 53 assist in resisting compressive forces acting on the lower margins of the conical wall portion 22 and 13 in the direction tending to urge these portions together. In order to provide further resistance to these forces, it is preferred to fill the zone overlying the margins with a layer of a compression-resistant material 58. Preferably, because of its ready availability, cheapness, and durability, cement grout is employed as a filling material 58. In order to seal the filling material 58 from contact with water or other liquid to be stored in the tank, an annular cover plate 59 is welded on the top of the stiffener plates 33 and 53. The annular plate 59 comprises a number of part sector shaped flat plates which are welded together at their edges and at their outer peripheries to the inner side of the outer wall portion 22 along a weld line 61 and to the inner conical wall portion 13 along a weld line 62. Conveniently, when cement grout is used as the filling material 58, prior to introducing the cement grout the heads of the bolts 29 are first capped with cylindrical covers 60 which are welded at their edges to the upper surfaces of the washers 37, in order to avoid risk of leakage of the liquid grout through the holes provided through the washers 37 and the horizontal plate 18, and the horizontal plate 59 is then welded in position, this being provided with inner and outer annular arrays of holes 63, these holes providing access to the closed generally triangular outer and inner cavities defined beneath the cover plate 59 on the outer and inner sides of the endless plate 54. Liquid cement grout is then introduced through the holes 63 until each inner and outer cavity is completely filled. Lateral holes 64 and 65 may be provided through the vertical stiffener plates 53 and 33 in order to assist in spreading the liquid grout evenly throughout the adjoining cavities. Care is taken to remove all trapped air from the cavities during the grouting operation. The holes 63 are then plugged with water tight stoppers, and the cement grout material is permitted to set up to its hardened condition. It is important to ensure that the bed of set cement grout is sealed from contact with water or similar liquids to be contained within the storage tank, as contact with these liquids, especially water, can result in deterioration of the mechanical properties of the cement grout. Particularly in northern climates, there is the risk that if the bed of hardened grout becomes permeated with water, this will result in breakdown of the cement grout material owing to the expansion and contraction forces exerted by the absorbed moisture during freeze-thaw cycles.

Following completion of the grouting operation, the steel access tube 14 may be hoisted into position, and welded around its lower edge to the upper edge of the short tubular section 32, and the pre-assembled upper portion of the cap portion 28 together with the cover plate 17 are then hoisted into place and welded to the upper edge of the lower roof portion 27 and to the upper rim of the access tube 14.

As shown in FIG. 2, a catwalk 66 may be provided within the interior of the shaft 10 to form a platform supporting the ladder 16 which extends upwardly through the interior access shaft 14. This catwalk 66 may be supported within the interior of the shaft 10 employing conventional anchors cast into the interior surface of the shaft 10, and, during the course of construction, may be assembled on the top of the working platform forming part of the form work used in the casting of the cylindrical wall constituting the shaft 10. A door 67 is provided in the side wall of the shaft 10, as shown in FIG. 1, from which ladders (not shown) in the interior of the shaft provide access to the catwalk 66.

The piping associated with the delivery of liquid to the storage tank and supply of stored liquid from the tank may be installed within the shaft 10 after securing the lower conical wall portion 13 on the top of the shaft and may include inlet and outlet pipes and an overflow pipe. These pipes may be passed through holes cut in the wall portion 13, the peripheries of the pipes being welded to the edges of the holes.

It will be noted that with the novel form of unitary tank bottom wall described in more detail above, having an upwardly and inwardly sloping inner conical wall and an upwardly and outwardly sloping outer conical wall, the forces transmitted from the tank body 12 to the shaft 10 when the former is loaded with liquid in service can be purely forces of compression which are borne by a compression reaction of the horizontal plate 18 against the upper horizontal surface of the shaft 10, and no bending moments are transmitted to the anchors 29 employed to secure the tank body on the top of the shaft 10. Analysis of the forces to which the metal plates composing the bottom wall are subjected in service shows that these can be readily withstood by standard grades of conventional steel construction materials. For example, in the case of a tank body as described above in detail with reference to the accompanying drawings having a main tank body portion 12 of approximately 44 feet diameter, a cylindrical side wall 24 of height approximately 25 feet, a shaft 10 of approximately 21 feet diameter, an outer conical wall portion 22 measured from the ring beam 23 to the upper surface of the shaft 10 approximately 14 feet in length, and an inner conical wall portion 13 measured from the upper surface of the shaft 10 to the centre of the access tube 14 approximately 11 feet in length, the maximum stresses to which the metal is subjected in service will be as follows:

- radial stress 8.21 ksi at a point in the outer wall 22 adjacent the point of connection of the horizontal plate 59
- flexural stress 5.02 ksi at the inner conical wall portion 13 adjacent the point of connection of the horizontal plate 59
- ring stress (tension) 4.56 ksi at a region in the outer wall portion 22 adjacent its upper margin; and
- ring stress (compression) 7.05 ksi in approximately the mid point of the horizontal plate 59.

It will be apparent that these stresses can be readily withstood by conventional steel construction plate of standard grades.

We claim:

1. An elevated liquid storage tank comprising an upwardly extending tubular concrete shaft providing a horizontal upper surface, a generally tubular metal tank body supported on the shaft and having a unitary bottom wall comprising an endless horizontal plate bearing on said surface, means securing the plate to said surface, an inner conical wall portion having an outer margin integrally connected to the plate and inclining upwardly from the plate toward the center of the tank, and an outer conical wall having an inner margin integrally connected to the plate and inclining upwardly from the plate to an outer end, and a tank side wall extending upwardly from the outer end of the outer conical wall, the tank bottom wall being adapted to withstand compressive forces urging the outer margin of the inner conical wall portion and the inner margin of the outer conical wall portion in the direction toward one another.

2. A tank as claimed in claim 1, including compression-resistant stiffening means distributed uniformly around an endless zone overlying said horizontal plate adjacent to and engaging with the inner surfaces of the outer margin of the inner conical wall portion and the inner margin of the outer conical wall portion.

3. A tank as claimed in claim 2 wherein said stiffening means comprise a bed of set cementitious material disposed in an even layer around said zone.

4. A tank as claimed in claim 3 wherein the cementitious material is cement grout.

5. A tank as claimed in claim 3 including sealing means sealing in water-tight fashion the bed of cementitious material from contact with liquid introduced into the interior of the tank.

6. A tank as claimed in claim 2 wherein the stiffening means comprise stiffener plates each extending radially in a vertical plane and having sides connected to the inner and outer conical wall portions, respectively.

7. A tank as claimed in claim 6 wherein the outer conical wall portion is divided by a circumferentially continuous weldment into a lower stub portion connected to the horizonal plate and an upper major portion, and said stiffener plates comprise an inner portion connected to the inner conical wall portion and the stub portion and an outer portion connected to the upper major portion of the outer conical wall portion, and including a circumferentially continuous flange connected to the inner sides of the outer stiffener plate portions and an angle plate connected between the flange and the outer end of each stiffener plate inner portion.

8. A tank as claimed in claim 6 wherein the stiffener means comprise a horizontal annular plate connected on the upper side of the stiffener plates and at its inner and outer peripheries to the inner and outer conical wall portion, respectively.

9. A tank as claimed in claim 1 in which the tubular shaft and the securing means comprise anchors cast in the upper end of the shaft, extending through holes in the horizontal plate, and fastening means retaining the horizontal plate in tight abutment with the upper end of the shaft.

10. A tank as claimed in claim 9 including an annular resilient pad disposed between the plate and the upper surface of the shaft.

11. A method for erecting an elevated storage tank comprising casting on a support surface an upwardly extending tubular concrete shaft having an annular horizontal upper surface, fabricating a metal tank bottom wall comprising an endless horizontal plate having an inner side and an outer side, an inner conical wall portion inclining upwardly from the inner side of the horizontal plate to a central portion, and an outer conical stub portion projecting upwardly from the outer side of the horizontal plate, securing the tank bottom wall on the top of the shaft by securing said horizontal plate on the top surface of the shaft, fabricating around the base of the shaft a metal tank body comprising an upwardly extending tank side wall having an opening in the top and having a downwardly inclining conical major bottom wall portion having a lower edge defining an opening at the bottom, said bottom and top openings providing sufficient clearance from the side of the shaft to permit the tank body to be drawn vertically up the shaft, drawing the tank body up the shaft until the lower edge of said conical major bottom wall portion coincides with the outer edge of the outer conical stub portion, securing the tank bottom wall to the tank body, welding the coinciding edges of the bottom opening and the stub portion together, and providing compression-resistant stiffening means uniformly around the endless zone overlying the horizontal plate and engaging the inner sides of a lower portion of the major bottom wall portion, the stub portion, and the inner conical wall portion.

12. A method as claimed in claim 10 wherein the stiffening means are provided by pouring an hydraulic cementitious material into the zone of the tank bottom overlying the upper surface of the shaft to form an even layer, and allowing the cementitious material to set.

13. A method as claimed in claim 12 wherein the cementitious material is cement grout.

* * * * *